United States Patent [19]

Pahis

[11] 4,395,977

[45] Aug. 2, 1983

[54] RECIPROCATE INTERNAL COMBUSTION ENGINE

[76] Inventor: Nikolaos S. Pahis, 507 Brimfield Rd., Wethersfield, Conn. 06109

[21] Appl. No.: 229,119

[22] Filed: Jan. 28, 1981

[51] Int. Cl.[3] ..... F02B 75/22

[52] U.S. Cl. ..... 123/55 AA; 123/197 AC

[58] Field of Search ..... 123/197, 55 AA, 56 C, 123/58 R, 58 A, 48 R, 48 A, 78 R, 78 E, 78 F, 55 A, 55 R

[56] References Cited

U.S. PATENT DOCUMENTS

| | | | |
|---|---|---|---|
| 370,709 | 9/1887 | Mathias et al. | 123/197 R |
| 712,361 | 10/1902 | Clarke | 123/197 AC |
| 1,123,172 | 12/1914 | Compton | 123/197 AC |
| 1,703,497 | 2/1929 | Noah | 123/197 R |
| 1,885,298 | 11/1932 | Schell | 123/54 B |
| 2,312,057 | 2/1943 | Williams | 123/55 AA |
| 3,945,358 | 3/1976 | Collins | 123/56 C |

*Primary Examiner*—Craig R. Feinberg

[57] ABSTRACT

A four-stroke reciprocate internal combustion engine which has at least one conventional piston mounted on a carrier body of a power transmission mechanism and both sliding in line on sliding means attached to the engine stator in a linear reciprocate motion. On said carrier is mounted a framed-type internally or externally teethed gear which can be fixed or sliding independently in a linear reciprocate motion perpendicular to the carrier's linear reciprocate motion. A circular-type externally teethed gear which is mounted on a rotatable power transmission shaft engages the teeth of the framed-type gear and they are held in constant engagement with the help of one or more independent and freely rotating follower rollers rolling on the external or internal surface of the framed-type gear exactly at the opposite side of gear's engagement point. Said power transmission shaft is mounted on bearing blocks which can be mounted fixed on the engine stator or can slide on sliding means attached to the engine stator in a linear or radian motion perpendicular to the carrier's linear reciprocate motion.

1 Claim, 12 Drawing Figures

RECIPROCATE INTERNAL COMBUSTION ENGINE

The invention relates to a four-stroke reciprocate internal combustion engine comprising of one conventional piston with its own sealing rings reciprocating in an inner cylindrical surface of the engine body. The top of said piston, the adjacent surface of the engine head and the surrounding inner cylindrical surface of the cylinder body are defining the combustion chamber in which all four strokes are accomplished: intake, compression, expansion and exhaustion. Said piston is mounted with a piston rod on the top external side of power transmission mechanism carrier. One or more of the external vertical sides of said carrier are formed to fit and slide in vertical reciprocate, smooth and linear motion and in line with the piston on one or more parallel sliding blocks which are permanently mounted on the engine stator. The carrier of power transmission mechanism carries a framed-type gear which consists of a frame and the gear itself. The gear itself can be circular or any of the types which have unequal axis, the major and the minor axis where the oval-type gear is included. The oval-type gear consists of two semi-circular parts which are opposite each other and which connect the ends of two straight, equally lengthed, parallel parts which are opposite each other and teethed either internally or externally for a smooth continuous engagement with the teeth of an externally teethed rotatable circular-type gear. The frame of the gear has at least one of its horizontal parallel sides formed for sliding on sliding means on corresponding sides formed for sliding in parallel on said carrier, sliding in a horizontal linear reciprocate motion which is parallel to the gear's flat surfaces and perpendicular to the gear's major center axis which passes through the centers of the two semi-circular parts of said gear. The framed gear engages a rotatable circular-type externally teethed gear which is mounted with a key on a rotatable power transmission shaft which is supported on one or both sides on bearing blocks which are mounted fixed on the engine's stator. The teeth of the framed and the circular rotatable gears are held engaged with one or more rollers independent and freely rotating on their shafts, rolling on the external or internal smooth and oval-type surfaces of oval-type gear, exactly at the opposite side of gears engagement point or rolling on a smooth oval-type surface made on the frame of the oval type gear and equally distant all around from the teeth of said gear. Each shaft of the follower roller is mounted on the end of the power transmission shaft or on one side of a positioner arm according to the needs. The other side of said positioner arm is mounted with bearing means and freely rotating on the rotatable power transmission shaft.

The principal object of the invention is to convert a linear reciprocate motion to a continuous circular motion by using the power transmission mechanism. Another object of the invention is to increase the power output of the convention piston reciprocate engine by using the power transmission mechanism instead of the conventional crank shaft which is subject to continuous power losses due to the change of angular crank shaft's positions. Another object of the invention is to increase the engine's power output by increasing the expansion stroke simply by increasing the length of straight parts of the oval-type internally teethed gear and having minimum effect in the performance of the engine. Another object of the invention is to apply direct forces on the teeth of circular gear during the expansion cycle, simply by positioning piston's center line in line with circular gear teeth circumferential center line. Another object of the invention is the reduction of engine vibration by reducing the rotating masses. Another object of the invention is the reduction of the noise level of the exhaustion products by reducing the gases exhaust pressure due to the increasing of said expansion stroke. Additional objects and features of the invention will become apparent from the following description of a preferred embodiment thereof.

The description will proceed with reference to the accompanying drawings, and the preferable oval type gear.

Figure 1:
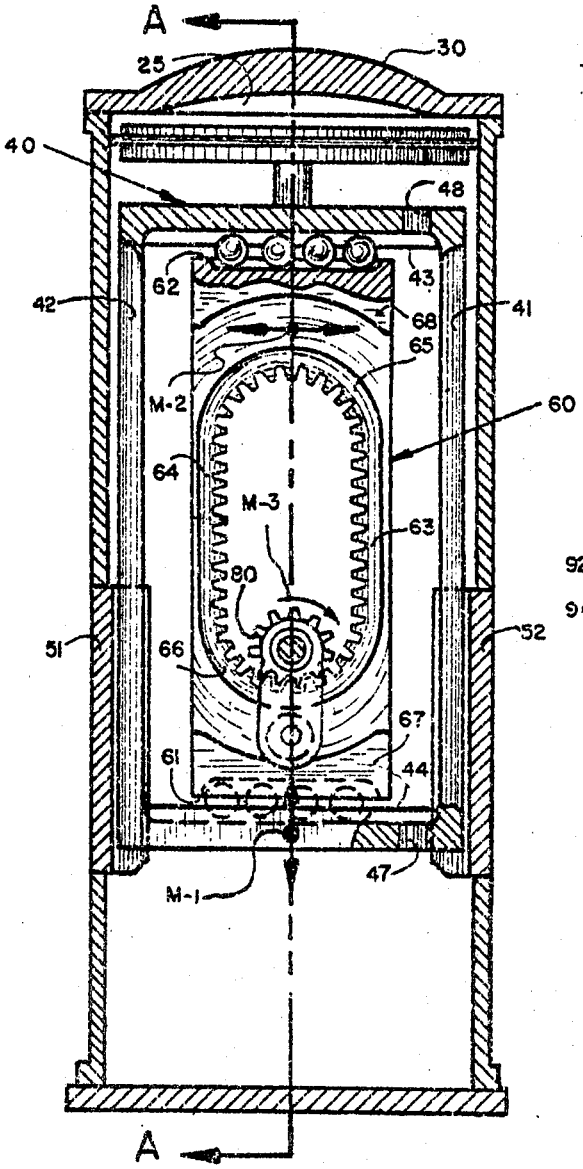
FIG. 1 is a vertical sectional view of the reciprocate internal combustion engine.
Figure 2:
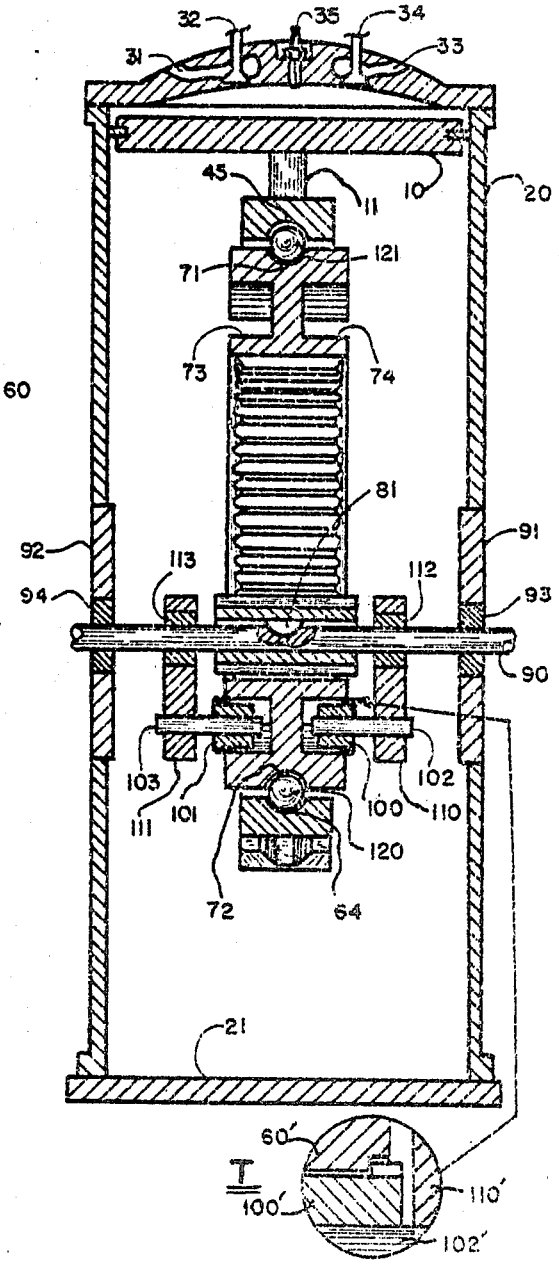
FIG. 2 is a fragmentary sectional view taken on line A—A of FIG. 1.

Referring to the FIGS. 1 and 2, cylindrical piston (10) with its own sealing rings reciprocates in the inner cylindrical surface of engine stator body (20). The top of piston (10) and the adjacent surface of engine head (30) which has an igniter or spray jet (31), inlet port (32) with valve (33), outlet port (34) with valve (35), and the surrounding inner cylindrical surface of cylinder body (20) are defining the combustion chamber (25). Said piston (10) is mounted with a piston rod (11) on the top external side of power transmission mechanism carrier (40).

The two external vertical and parallel (41 and 42) sides of power transmission mechanism carrier (40) are formed to fit and slide in vertical reciprocate motion (M-1) on two parallel sliding blocks (50, 51) which are permanently mounted on engine stator (20). Within the carrier (40) of power transmission mechanism lies framed oval-type gear (60) internally teethed and reciprocating in linear motion (M-2) on its two parallel horizontal sides (61, 62). Oval-type gear consists of six parts: two straight teethed parts (63, 64), two semi-circular parts (65, 66) and the two parallel horizontal sides (67, 68) which are part of the gear's frame. Inside the oval-type gear (60) lies a rotatable circular type externally teethed gear (80) rotating in a clockwise motion (M-3). Circular gear (80) is mounted with a key (81) on rotatable power transmission shaft (90) which is supported on bearing blocks (91, 92) with bearing (93, 94) and said bearing blocks (91, 92) are mounted fixed on the stator (20). The two gears are held in constant engagement with the help of rollers (100, 101) rolling on the external surfaces (73, 74) of oval-type gear (60) and rotate on shafts 102, 103 of positioner arms (110, 111). Positioner arms are mounted to rotate freely on bearings (112, 113) which are mounted on the rotatable power transmission shaft (90). A small part of rollers (100, 101) cylindrical surfaces, and a small part of the external surfaces (73, 74) of oval-type gear have gear-type teeth as enlarged section (T) shows which are engaging constantly in order to keep follower rollers constantly opposite to the engagement point of gear (60) and gear (80). The inner horizonal surfaces (43, 44) of power transmission carrier (40) and the adjacent horizontal surface (71, 72) of oval-type gear are forming channels (45, 71) for ball rollers (120) and channels (64, 72) for ball rollers (121). Ball rollers (120, 121) are inserted in place through holes (47, 48) of power transmission mechanism carrier (40). The engine is enclosed with a bottom base (21) mounted on stator body (20).

As seen in FIG. 1, an initial clockwise motion (M-3) on power transmission shaft (90) is transmitted to circular gear (80), circular gear (80) advances on the semi-circular part (66) of oval gear (60). Each point then of oval gear (60) follows a sharp eliptical path which is translated to a linear motion (M-1) which transfers through carrier (40) and piston rod (11) to piston (10) of the engine and a linear motion (M-2) to the left. When gear (80) advances on the straight part (63) of oval gear (60), oval gear's motion (M-2) is a linear downwards only. When circular gear (80) advances on the semi-circular part (65) again each point of oval gear moves in an eliptical path which translated to a linear motion to the right till the end of the semi-circular part and a linear motion (M-1) downwards till the circular gear (80) reaches the center of the semi-circular part (65). From that point and after the linear motion (M-1) is going to be upwards until the circular gear (60) reaches the center of semi-circular part (66). It is apparent although the motion (M-3) of gear (80) is continuously uninterrupted, the motion (M-1) is a reciprocate one, that of a desired conventional reciprocate engine.

Figure 3:
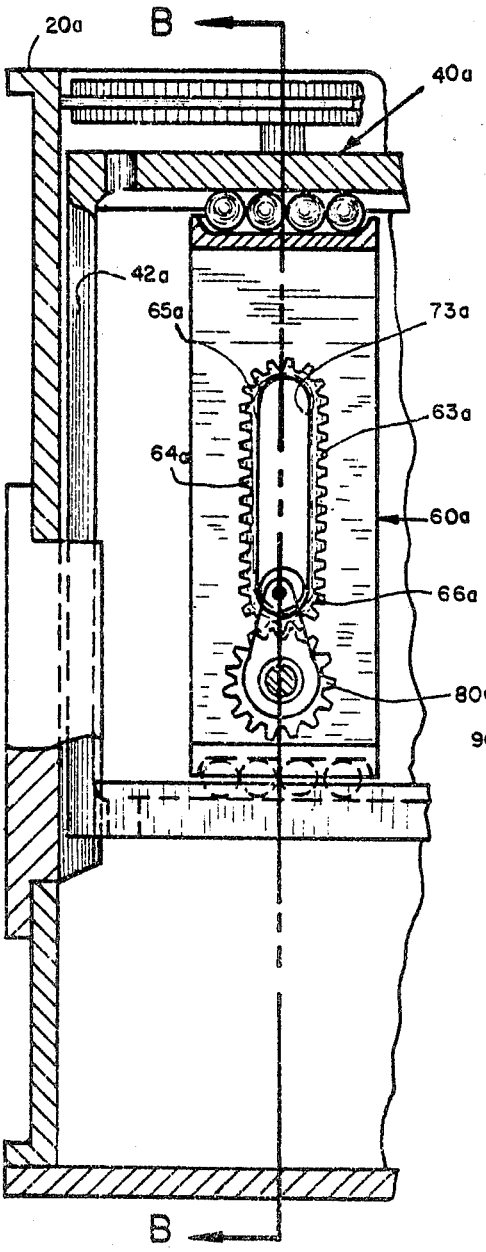
FIG. 3 is a part of a vertical sectional view of another embodiment of the reciprocate internal combustion engine.
Figure 4:
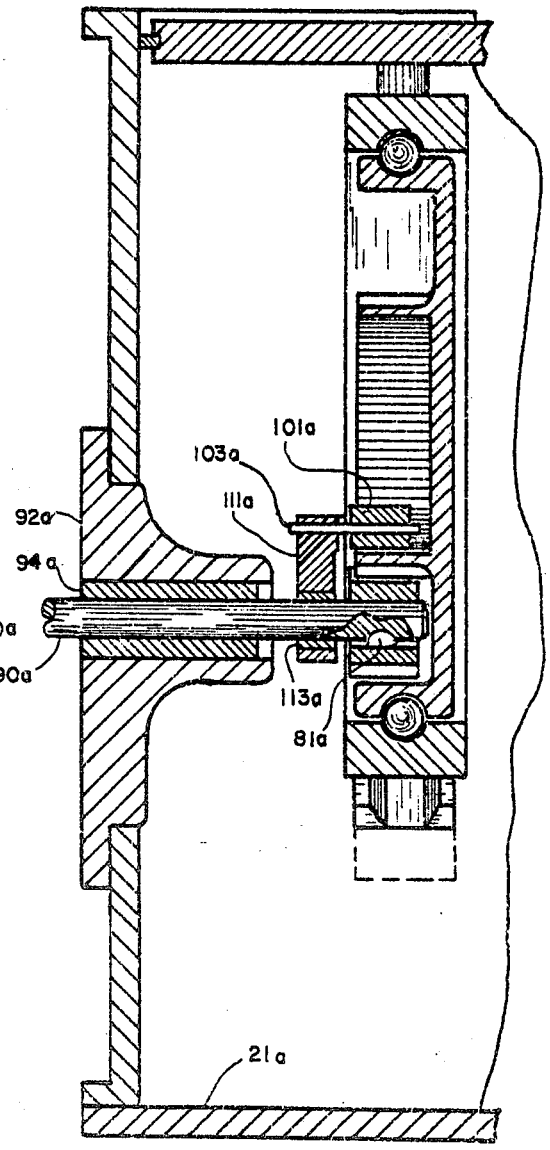
FIG. 4 is a fragmentary sectional view taken on line B—B of FIG. 3.

Referring to the drawing, FIGS. 3 and 4 are basically the same as FIGS. 1 and 2 except that the circular type externally teethed gear (**80*a*) which is mounted on a rotatable shaft (90*a*) engages an oval type externally teethed gear (60*a*) and a follower roller (101*a*) is rolling on an inside oval shaped, smooth surface (73*a*) and the rotatable shaft (90*a*) is supported for rotation on bearing block (92*a***) on one side.

Figure 5:
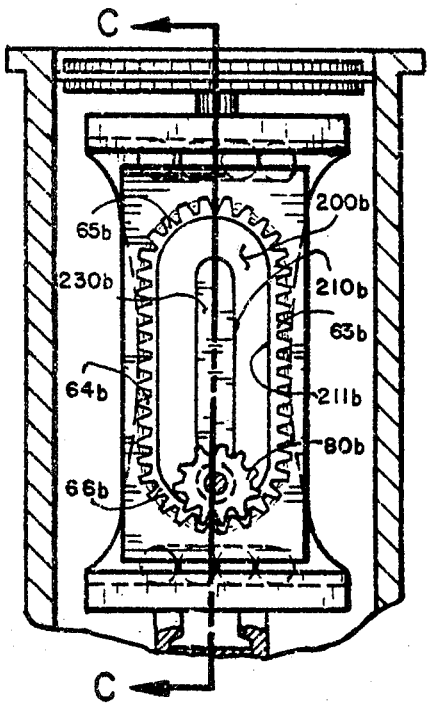
FIG. 5 is a part of a vertical sectional view of another embodiment of the reciprocate internal combustion engine.
Figure 6:
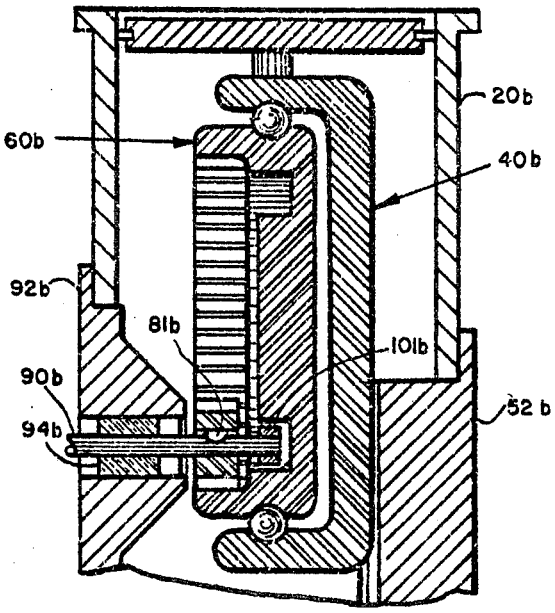
FIG. 6 is a fragmentary sectional view taken on line C—C of FIG. 5.

Referring to the drawings, FIGS. 5 and 6 are on the basis of FIGS. 1 and 2 except that the carrier body (**40*b*) has for linear sliding only one sliding slide and the circular type externally teethed gear (80*b*), which is mounted on the rotatable power transmission shaft (90*b*), is held in constant engagement to the oval type internally teethed gear (60*b*) with the help of a freely rotating follower roller (101*b*) which is mounted at the end of the rotatable power transmission shaft (90*b*) and in line with gear (80*b*). The followers external smooth cylindrical surface rolls parallel to the smooth and oval shaped surface (210*b*) and partly on the oval shaped surface (211*b*). Surface (210*b*) and (211*b*) are projected parallel above the flat surface of the oval shaped channel (200*b*). Surface (210*b*) is the external oval shaped surface of lobe (230*b*). Surface (210*b*) is equally distant from the base axis of the oval type gear teeth. Also, oval shaped surface (211*b*) is equally distant from the base axis of the oval type gear teeth. Channel (200*b*) has a width equal to the need for free rotation of follower roller (101*b***).

Figure 7:
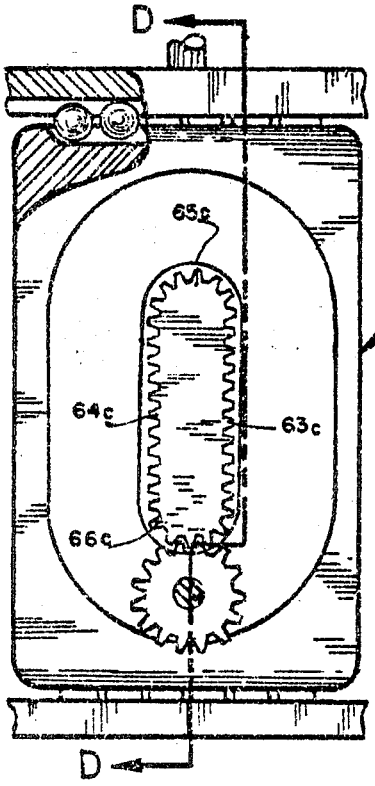
FIG. 7 is a part of a vertical sectional view of another embodiment of the reciprocate internal combustion engine.
Figure 8:
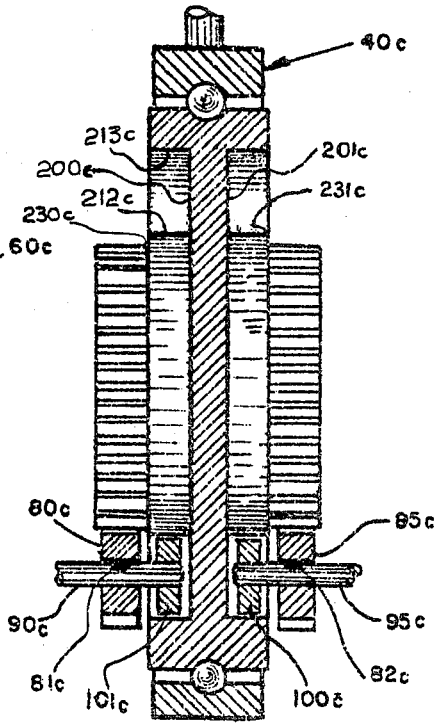
FIG. 8 is a fragmentary sectional view taken on line D—D of FIG. 7.

Referring to the drawings, FIGS. 7 and 8 are on the basis of FIGS. 3 and 4, and FIGS. 5 and 6 except that on frame (**60*c*) are formed two identical oval type externally teethed gears which are projected above two projected lobes (230*c* and 231*c*) with common center axis and opposite each other. Said oval type gears are engaging two independent circular gear externally teethed (80*c* and 85*c*) with each gear mounted on each of their shafts (90*c* and 95*c*). At the end of each shaft is mounted a free rotating follower roller (100*c* and 101*c*) with Roller (100*c*) rolls on and between the oval surfaces (210*c* and 211*c*). Roller (101*c*) rolls on and between the oval surfaces (212*c* and 213*c***).

An oval type internally teethed gear (**60*d*) is mounted fixed on the sliding carrier (40*d*) which slides on the stator body (20*d***) in a linear reciprocate motion (M-1*d*). A circular externally teethed gear (**80*d*) engages the oval type gear (60*d*) and is held engaged with the help of a follower roller (100*d*) rolling on and in between the oval tpe surfaces (210*d* and 211*d*). Said surface (210*d*) is the external surface of a projected lobe (230*d*) above surface of channel (200*d*) and with surface (211*d*) parallel to the lobe's surface (210*d*) and parallel to the roller's (100*d*) external cylindrical surface and parallel to a power transmission shaft's center axis. Gear (80*d*) is mounted fixed in line with the follower roller (100*d*) and at the same end of a shaft (90*d*). On the other end of shaft (90*d*) is also mounted fixed a circular type externally teethed gear (85*d*) which engages a circular externally teethed gear (86*d*) which is mounted to rotate with shaft (95*d*). Shaft (90*d*) is supported to rotate on bearing means (93*d*) of a bearing block (18*d*) in between the two gears (80*d*) and (85*d*). Said bearing block (18*d*) is sliding with sliding means on stator body (20*d***) in a radian motion (M-2*d*) and with radian's center the center of shaft (**95*d*) in order for gear (86*d***) to have a continuous circular motion (M-3*d*) as bearing block (**18*d***) swings in motion (M-2*d*).

Figure 9:
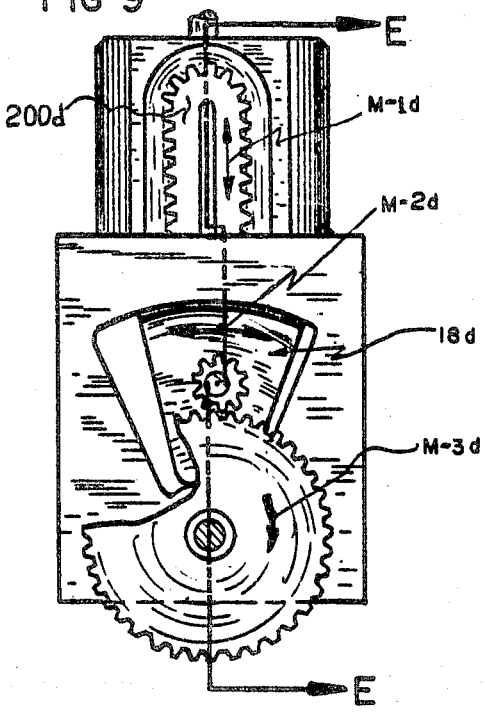
FIG. 9 is a part of a vertical sectional view of another embodiment of the reciprocate internal combustion engine.
Figure 10:
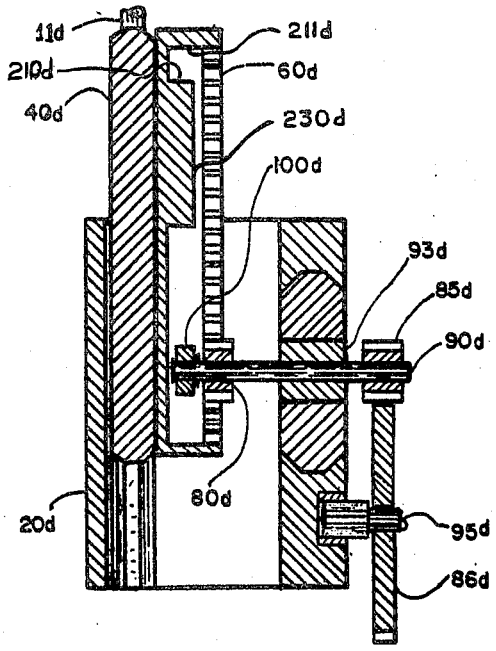
FIG. 10 is a fragmentary sectional view taken on line E—E of FIG. 9.
Figure 11:
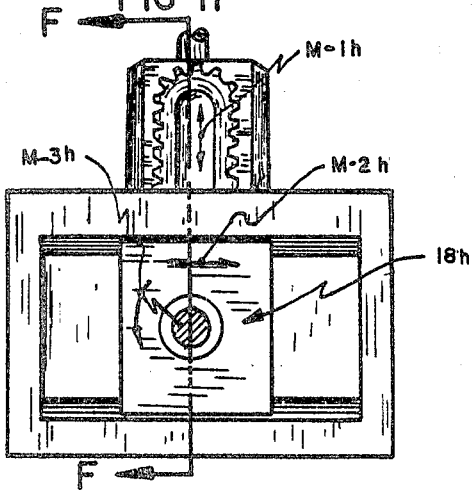
FIG. 11 is a part of a vertical sectional view of another embodiment of the reciprocate internal combustion engine.
Figure 12:
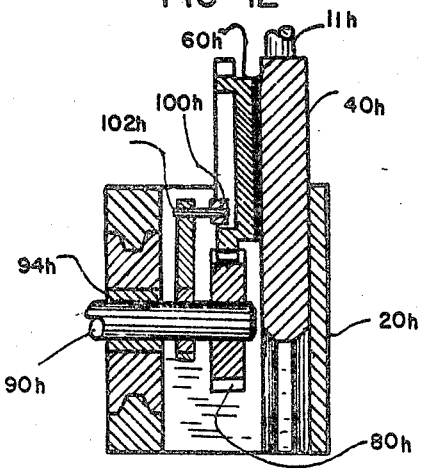
FIG. 12 is a fragmentary sectional view taken line F—F of FIG. 11.

Referring to the drawings, FIGS. 11 and 12 are on the basis of FIGS. 9 and 10 except that the oval-type gear (**60*h*), which is mounted fixed on the sliding carrier (40*h*) which slides on the stator (20*h*), is externally teethed. Oval-type gear (60*h*) is held engaged to a circular externally teethed gear (80*h*) with a freely rotating follower roller (100*h*) which rolls in an inner side oval type of gear (60*h*). The roller rotates on the shaft (102*h*) which is mounted at the end of a control arm and with the other side of the control arm mounted and rotates on the power transmission shaft (90*h*). The power transmission shaft is supported for rotation on a bearing block (18*h*) with bearing (94*h***). The motion of a carrier with a fixed gear is a linear reciprocate one (M-1*h*). The motion of the bearing block is also a linear reciprocate (M-2*h*) but is perpendicular to the carrier's linear reciprocate motion (M-1*h*). The motion of the power transmission shaft (**90*h***) is a circular one (M-3*h*).

I claim:

1. In a linearly reciprocating internal combustion engine, a power transmission mechanism for converting linear reciprocating motion of a piston (10) to a continuous rotary motion of a drive shaft (90) comprising:

a vertically oriented stator body assembly (20);

a cylindrical piston (10) within one end of the stator assembly adapted to move vertically therewithin;

a piston rod (11) fixedly connected to a central area of and extending longitudinally below the axis of the piston;

a carrier body assembly (40) fixedly connected to and centered longitudinally below the piston rod;

sliding blocks (50, 51) mounted within the stator body (20) for slidingly engaging a portion of the carrier body assembly to permit guided, vertical, reciprocal motion of the carrier body within the stator body as the piston reciprocates;

a sliding gear frame assembly (60) including upper and lower horizontal end portions (62, 61) slidingly mounted within the carrier body assembly (40) for simultaneous reciprocating horizontal movement (M-2) of the gear frame within the carrier body as the carrier body moves vertically (M-1), said gear frame assembly further including, (a) roller means (121, 120) on the upper and lower horizontal end portions (62, 61), for cooperating with mating channels (45, 72) on the carrier body assembly to permit relative sliding horizontal motion therebetween, (b) a vertically oriented, internally toothed oval gear having semi-circular upper and lower portions (65, 66) and straight side portions (63, 64), (c) a track surface (73, 74) surrounding the oval gear, between the upper and lower horizontal end portions (62, 61) and (d) transmission drive shaft mounting means, including (i) a circular externally toothed gear (80) meshed within said oval gear and engaging (81) said drive shaft (90) to impart rotational movement (M-3); and (ii) a pair of rollered positioner arms (112, 113, 102, 103, 110, 111) joining the drive shaft (90) to the track surface (73, 74) for maintaining firm engagement between the circular gear (80) and the oval gear throughout the reciprocating cycle, whereby the circular gear (80) and drive shaft (90) remain in a fixed location within the stator body (20) directly below the piston rod (11) as the gear frame assembly (60) moves vertically and horizontally, and the circular gear remains in continuous engagement with the oval gear.

* * * * *